United States Patent [19]

Hor et al.

[11] Patent Number: 4,555,463

[45] Date of Patent: Nov. 26, 1985

[54] PHOTORESPONSIVE IMAGING MEMBERS WITH CHLOROINDIUM PHTHALOCYANINE COMPOSITIONS

[75] Inventors: Ah-Mee Hor, Mississauga; Rafik O. Loutfy, Willowdale, both of Canada

[73] Assignee: Xerox Corporation, Stamford, Conn.

[21] Appl. No.: 643,218

[22] Filed: Aug. 22, 1984

[51] Int. Cl.[4] ..... G03G 5/10

[52] U.S. Cl. ..... 430/59; 430/76; 430/96; 430/126

[58] Field of Search ..... 430/58, 59, 76, 96, 430/64

[56] References Cited

U.S. PATENT DOCUMENTS

| | | | |
|---|---|---|---|
| 3,973,959 | 8/1976 | Rochlitz et al. | 96/1.5 |
| 4,311,775 | 1/1982 | Regan | 430/37 |
| 4,370,399 | 1/1983 | Ghosh et al. | 430/58 |
| 4,410,616 | 10/1983 | Griffiths | 430/59 |

*Primary Examiner*—John L. Goodrow

*Attorney, Agent, or Firm*—E. O. Palazzo

[57] ABSTRACT

Disclosed are improved photoresponsive imaging members comprised of chloroindium phthalocyanine photogenerating compositions. More specifically, there is disclosed a photoresponsive imaging member comprised of a supporting substrate, an adhesive layer, a chloroindium phthalocyanine photogenerating pigment in contact with the adhesive layer, and a hole transport layer comprised of an aryl amine dispersed in an inactive resinous binder. There is also disclosed photoresponsive imaging members comprised of a first photogenerating layer, and a second photogenerating layer, which imaging members are sensitive to light in the region of from about 400 to about 900 nanometers.

27 Claims, 6 Drawing Figures

PHOTO SENSITIVITY CURVES FOR CHLOROINDIUM PHTHALOCYANINE PHOTORECEPTOR OF FIGURE 2

ABSORPTION SPECTRUM OF AN EVAPORATED CHLOROIDIUM PHTHALOCYANINE FILM

ABSORPTION SPECTRUM OF AN EVAPORATED CHLOROINDIUM PHTHALOCYANINE FILM AFTER BEING OVERCOATD WITH A SPECIFIC AMINE TRANSPORT LAYER AND DRIED AT 135° C FOR 20 MINUTES – MEMBER OF FIGURE 2

PHOTORESPONSIVE IMAGING MEMBERS WITH CHLOROINDIUM PHTHALOCYANINE COMPOSITIONS

BACKGROUND OF THE INVENTION

This invention is generally directed to photoresponsive imaging members, and more specifically the present invention is directed to photoresponsive imaging members containing therein as photogenerating pigments chloroindium phthalocyanine compositions. Thus, in one embodiment, the present invention envisions the use of chloroindium phthalocyanine compositions of matter as photogenerating pigments in photoresponsive imaging members having incorporated therein specific arylamine hole transport molecules. In another embodiment of the present invention there are provided photoresponsive imaging members with a photogenerating layer comprised of the chloroindium phthalocyanine compositions disclosed herein, and a photoconductive layer, enabling the resulting members to possess photosensitivity in the wavelength region of from about 400 to about 900 nanometers. Imaging members with the chloroindium phthalocyanine compositions of the present invention are useful in electrophotographic imaging and printing systems, especially xerographic systems, wherein the resulting members are sensitive to visible light, and infrared illumination needed for laser printing.

Numerous different xerographic photoconductive members are known including, for example, a homogeneous layer of a single material such as vitreous selenium, or a composite layered device consisting of a dispersion of a photoconductive composition. An example of a composite xerographic photoconductive member is disclosed in U.S. Pat. No. 3,121,006, wherein there is illustrated finely divided particles of a photoconductive inorganic compound dispersed in an electrically insulating organic resin binder. The binder materials disclosed in this patent comprise a material which is incapable of transporting for any significant distance injected charge carriers generated by the photoconductive particles. Accordingly, as a result, the photoconductive particles must be in a substantially contiguous particle-to-particle contact throughout the layer for the purpose of permitting charge dissipation required for a cyclic operation. Thus, with the uniform dispersion of photoconductive particles described, a relatively high volume concentration of photoconductor material, about 50 percent by volume, is usually necessary in order to obtain sufficient photoconductor particle-to-particle contact for rapid discharge. This high photoconductive loading can result in destroying the physical continuity of the resinous binder, thus significantly reducing the mechanical properties thereof. Illustrative examples of specific binder materials disclosed in the '006 patent include, for example, polycarbonate resins, polyester resins, polyamide resins, and the like.

There are also known photoreceptor materials comprised of inorganic or organic materials wherein the charge carrier generating, and charge carrier transport functions, are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain higher quality images.

Recently, there has been disclosed other layered photoresponsive imaging members including those comprised of separate generating layers, and transport layers, reference U.S. Pat. No. 4,265,990, and overcoated photoresponsive materials containing a hole injecting layer, overcoated with a hole transport layer, followed by an overcoating of a photogenerating layer, and a top coating of an insulating organic resin, reference U.S. Pat. No. 4,251,612. Examples of photogenerating layers disclosed in these patents include trigonal selenium and phthalocyanines, while examples of transport layers include certain diamines as mentioned herein. The disclosures of each of these patents, namely, U.S. Pat. Nos. 4,265,990 and 4,251,612, are totally incorporated herein by reference.

Many other patents are in existence describing photoresponsive members, reference U.S. Pat. No. 3,041,167, which discloses an overcoated imaging member with a conductive substrate, a photoconductive layer, and an overcoating layer of an electrically insulating polymeric material. This member is utilized in an electrophotographic copying method by, for example, initially charging the member, with an electrostatic charge of a first polarity, and imagewise exposing to form an electrostatic latent image which can be subsequently developed to form a visible image. Prior to each succeeding imaging cycle, the imaging member can be charged with an electrostatic charge of a second polarity, which is opposite in polarity to the first polarity. Sufficient additional charges of the second polarity are applied so as to create across the member a net electrical field of the second polarity. Simultaneously, mobile charges of the first polarity are created in the photoconductive layer by applying an electrical potential to the conductive substrate. The imaging potential which is developed is present across the photoconductive layer and the overcoating layer.

There is also disclosed in Belgium Pat. No. 763,540, an electrophotographic member having at least two electrically operative layers, the first layer comprising a photoconductive layer which is capable of photogenerating charge carriers, and injecting the carriers into a continuous active layer containing an organic transporting material which is substantially nonabsorbing in the spectral region of intended use, but which is active in that it allows the injection of photogenerated holes from the photoconductive layer and allows these holes to be transported through the active layer. Additionally, there is disclosed in U.S. Pat. No. 3,041,116, a photoconductive material containing a transparent plastic material overcoated on a layer of vitreous selenium contained on a substrate.

Furthermore, there is disclosed in U.S. Pat. Nos. 4,232,102 and 4,233,383, photoresponsive imaging members comprised of trigonal selenium doped with sodium carbonate, sodium selenite, and trigonal selenium doped with barium carbonate, and barium selenite or mixtures thereof.

Additionally, the use of squaraine pigments in photoresponsive imaging devices is known, reference for example U.S. Pat. No. 4,415,639, the disclosure of which is totally incorporated herein by reference, wherein there is described an improved photoresponsive device comprised of a substrate, a hole blocking layer, an optional adhesive interface layer, an organic photogenerating layer, a photoconductive composition capable of enhancing or reducing the intrinsic properties of the photogenerating layer, and a hole transport layer. As photoconductive compositions for this device, there can be selected various squaraine pigments, including hydroxy squaraine compositions of the formula as outlined on page 13, beginning at line 21, of the copending application. The imaging member of this patent is useful in electrophotographic imaging and printing systems, in that the member is sensitive to wavelengths of from about 400 to in excess of 800 nanometers. Moreover, there is disclosed in U.S. Pat. Nos. 3,824,099 and 4,390,610, certain photosensitive hydroxy squaraine compositions. According to the disclosure of the '610 patent, the squaraine compositions are photosensitive in normal electrostatographic imaging systems.

The use of certain selected perylene pigments as photoconductive substances is also known. There is thus described in Hoechst, European Patent Publication No. 0040402, BE3019326, filed 5/21/80, the use of N,N'-disubstituted perylene-3,4,9,10,-tetracarboxyl diimide pigments as photoconductive substances. Specifically, there is disclosed in this publication dual layered photoreceptors, with improved spectral response in the wavelength region of 400 to 700 nanometers containing evaporated N,N'-bis(3-methoxypropyl)perylene-3,4,8,10 tetracarboxyldiimide. It is important to note that these perylenes are insoluble pigments, accordingly photoconductive devices with such compositions must be prepared by vacuum evaporation techniques. A similar disclosure is illustrated in Ernst Gunther Schlosser, Journal of Applied Photographic Engineering, Vol. 4, No. 3, page 118 (1978). Also, dual layered photoreceptors prepared from the perylene pigments as described in the above mentioned 0040402 publication can only be charged negatively thus requiring the use of positively charged toner compositions.

Moreover, there is disclosed in U.S. Pat. No. 4,419,427 electrophotographic recording mediums with a photosemiconductive double layer comprised of a first layer containing charge carrier producing dyes, and a second layer containing one or more compounds which are charge carrier transporting materials when exposed to light, wherein perylene diimides are employed as the charge carrier producing dyes. Examples of charge carrier transporting compounds disclosed in the '427 patent include pyrazoline derivatives, triphenylamines, and pyrene derivatives.

While many of the above-described imaging members are suitable for their intended purposes, there remains a need for improved members. Additionally, there continues to be a need for improved photogenerating materials possessing superior photosensitive properties, and wherein these pigments need not be dispersed in resinous binders when incorporated into a layered imaging member. Further, there continues to be a need for layered imaging members which require less light exposure in view of their high sensitivity, and wherein the resulting imaging members can be selected for use in high speed electrophotographic systems, particularly those generating copies of from about 60 to about 100 copies per minute. Also, there continues to be a need for layered imaging members comprised of the chloroindium phthalocyanine photogenerating compositions disclosed herein, and photoconductive substances, particularly organic substances such as perylene compositions, enabling the resulting members to be sensitive to wavelengths of from about 400 to about 900 nanometers. Further, there is a need for imaging members which are simultaneously useful for electrostatographic imaging systems sensitive to visible light, and printing systems wherein the resulting devices must possess sensitivity in the infrared region of the spectrum, that is exceeding about 750 nanometers.

SUMMARY OF THE INVENTION

It is an object of the present invention to provide improved photoresponsive imaging members which overcome some of the above noted disadvantages.

A further specific object of the present invention is the provision of an improved photoresponsive member containing therein as photogenerating pigments chloroindium phthalocyanine compositions.

It is yet another object of the present invention to provide an improved layered photoresponsive imaging member with an arylamine hole transport layer and a photogenerating layer comprised of chloroindium phthalocyanine compositions.

In yet another object of the present invention, there is provided layered imaging members of superior photosensitivity enabling their use in high speed electrophotographic imaging systems.

In yet another object of the present invention there are provided layered imaging members which are sensitive to visible light and infrared illumination, and are comprised of chloroindium phthalocyanine compositions as the photogenerating pigment.

A further object of the present invention resides in the provision of a layered photoresponsive imaging member comprised of the chloroindium phthalocyanine pigments illustrated herein, and an organic or inorganic pigment which absorbs blue light in the region of from about 400 to about 600 nanometers, enabling the resulting member to be sensitive to visible light and infrared light.

In yet a further object of the present invention there is provided an imaging member with improved white light photosensitivity for the chloroindium phthalocyanine photogenerating pigment by adding thereto a thin layer of a photogenerating dye, including perylenes, which absorbs blue light from about 400 to about 600 nanometers.

In yet a further object of the present invention there is provided an imaging member with improved white light photosensitivity for chloroindium phthalocyanine photogenerating pigment by adding thereto a thin layer of an inorganic photoconductor, including selenium and its alloys or selenium dispersions which absorb blue light from 400 to 600 nanometers.

In yet another object of the present invention there are provided imaging and printing methods with the improved photoresponsive members described herein.

These and other objects of the present invention are accomplished by the provision of photoresponsive imaging members, or devices containing therein as a photogenerating pigment chloroindium phthalocyanine compositions. More specifically, in one embodiment the present invention is directed to photoresponsive imaging members comprised of a chloroindium phthalocyanine photogenerating layer, and an arylamine hole transport layer. In one preferred embodiment of the present invention the photoresponsive imaging members are comprised of a supporting substrate, an adhesive layer, a photogenerating layer comprised of chloroindium phthalocyanine, and a charge transport layer comprised of certain arylamines dispersed in an inactive resinous binder composition.

There is also provided in accordance with the present invention a photoresponsive imaging member simultaneously photosensitive to visible light, and infrared radiation; to a wavelength region of from about 400 to about 900 nanometers; comprised of a supporting substrate, an adhesive layer, a dye which absorbs blue light from about 400 to about 600 nanometers, a photogenerating layer comprised of chloroindium phthalocyanine, and a charge transport arylamine layer in contact therewith. These members thus comprise a photogenerating layer consisting of two photogenerating pigments, chloroindium phthalocyanine, and the pigment which absorbs blue light. The resulting imaging members are sensitive to visible light, and infrared light, enabling their convenient use in printing systems with low cost laser devices, including solid state infrared lasers.

The improved photoresponsive imaging members of the present invention can be prepared by a number of known methods, the process parameters and the order of coating of the layers being dependent on the imaging member desired. Thus, for example, the photoresponsive imaging members of the present invention can be prepared by providing a supporting substrate, with an adhesive layer thereover followed by adding thereto as a separate layer by evaporation N,N'-dimethylperylene-3,4,9,10-tetracarboxyl diimide, or other blue light absorber, and the chloroindium phthalocyanine composition, and subsequently depositing by solution coating the arylamine hole transporting layer thereover.

Furthermore, the chloroindium phthalocyanine compositions, selected for the imaging members of the present invention, are generally known and can be obtained by the reaction as described in *Inorganic Chemistry,* 1980, Vol. 19, pages 3131–3135, entitled "Studies of a Series of Haloaluminum, Gallium, and Indium Phthalocyanines", the disclosure of this article being totally incorporated herein by reference.

Moreover, the improved photoresponsive imaging members of the present invention can be incorporated into various imaging systems, inclusive of those conventionally known as xerographic imaging processes. Additionally, the improved photoresponsive imaging members of the present invention can function simultaneously in imaging and printing systems, or in printing systems alone, with visible light and/or infrared light. In these embodiments, the imaging members of the present invention may be appropriately charged, exposed to light in a wavelength of from about 400 to 900 nanometers, either sequentially, or simultaneously, followed by development, and transfering of the resulting image to a substrate. The sequence may be repeated in a continuous xerographic imaging, or printing systems, with visible light and/or infrared illumination.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
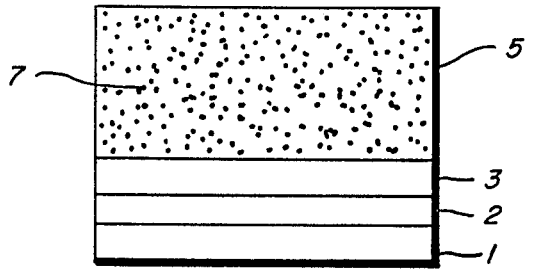
FIG. 1 is a partially schematic cross-sectional view of a photoresponsive imaging member of the present invention.

Illustrated in FIG. 1 is the photoresponsive imaging member of the present invention comprised of a substrate 1, an adhesive layer 2, a photogenerating layer 3, comprised of the photogenerating pigment chloroindium phthalocyanine, and a hole transport layer 5, comprised of an arylamine hole transporting substance dispersed in a resinous binder composition 7.

Figure 2:
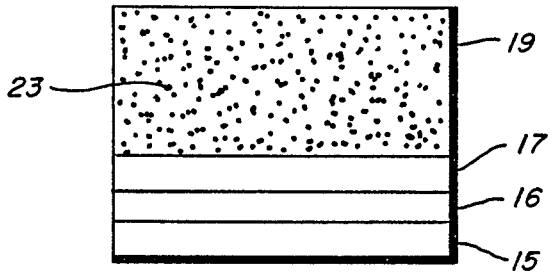
FIG. 2 is a partially schematic cross-sectional view of a photoresponsive imaging member of the present invention.

Illustrated in FIG. 2 is one preferred photoresponsive imaging member of the present invention comprised of an aluminized Mylar supporting substrate 15, a polyester adhesive layer 16, a photogenerating layer 17, comprised of the photogenerating pigment chloroindium phthalocyanine, and a hole transport layer 19, applied from a solution of methylene chloride, and comprised of the arylamine hole transporting molecule N,N'-diphenyl-N,N'-bis(3-methylphenyl)-[1,1'-biphenyl]-4,4'-diamine, dispersed in a polycarbonate resinous binder 23.

Figure 3:
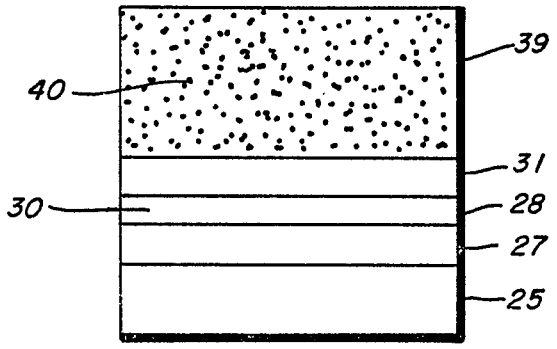
FIG. 3 is a partially schematic cross-sectional view of a photoresponsive imaging member of the present invention.

Illustrated in FIG. 3 is another preferred photoresponsive imaging member of the present invention, sensitive simultaneously to visible light, and infrared radiation, comprised of an aluminized Mylar substrate 25, an adhesive layer 27, a photogenerating layer 28, comprised of the photogenerating pigment N,N'-dimethylperylene 3,4,9,10-tetracarboxyldiimide 30, a photogenerating layer 31, comprised of chloroindium phthalocyanine, and a hole transport layer 39, comprised of the arylamine hole transporting molecule N,N'-diphenyl-N,N'-bis(3-methylphenyl)-[1,1'-biphenyl]-4,4'-diamine, dispersed in a polycarbonate resinous binder 40.

Figure 4:
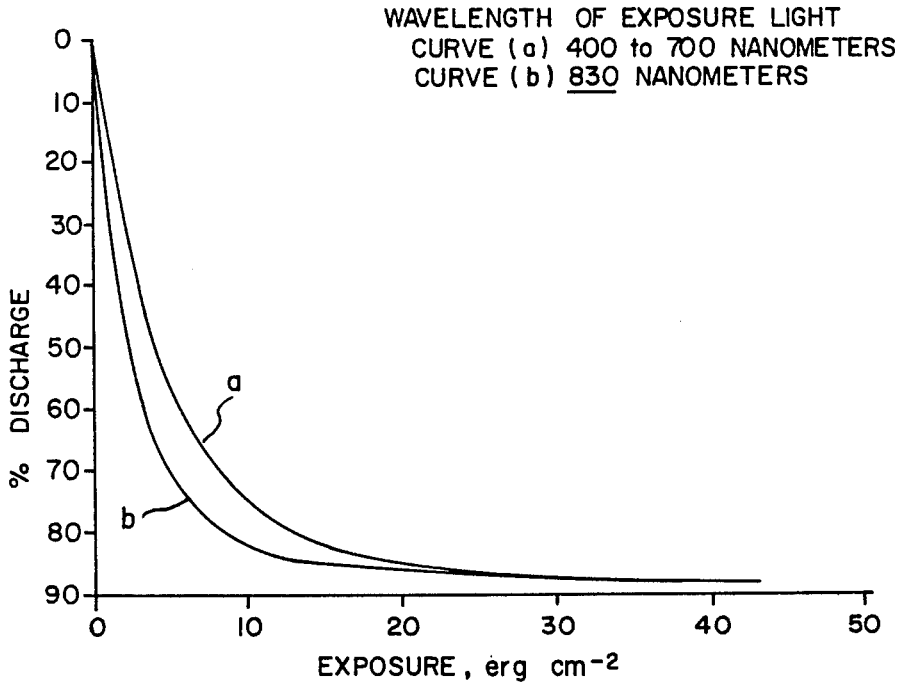
FIG. 4 is a line graph illustrating the percent of discharge versus exposure in ergs per square centimeter for the imaging member of FIG. 2, wherein curve (A) of this Figure is generated under white light of a wavelength of from 400 to 700 nanometers, while curve (B) was obtained by exposing the imaging member of FIG. 2 with infrared light of a wavelength of 830 nanometers.

Illustrated in FIG. 4 is a line graph representing the percent discharge versus the exposure in ergs per square centimeter for the imaging member of FIG. 2 wherein the thickness of the substrate is 3 mils, the adhesive layer thickness is 0.1 microns, the photogenerating layer thickness is 0.1 microns, and the hole transport layer thickness is 15 microns. More specifically, there is illustrated in this figure the percent of surface potential being discharged from the same initial surface potential, −800 volts after the charge imaging member is exposed to various light intensity levels, reference exposure erg $cm^{-2}$ in the wavelength region of 830 nanometers, reference curve (b), and white light of 400 to 700 nanometers, reference curve (a). Reference to curve 4 (b) indicates that at 10 ergs $cm^{-2}$ of 830 nanometers light there is a discharge of greater than 80 percent, and that at 400 to 700 nanometers, curve 4 (a), the discharge is about 75 percent.

Figure 5A:
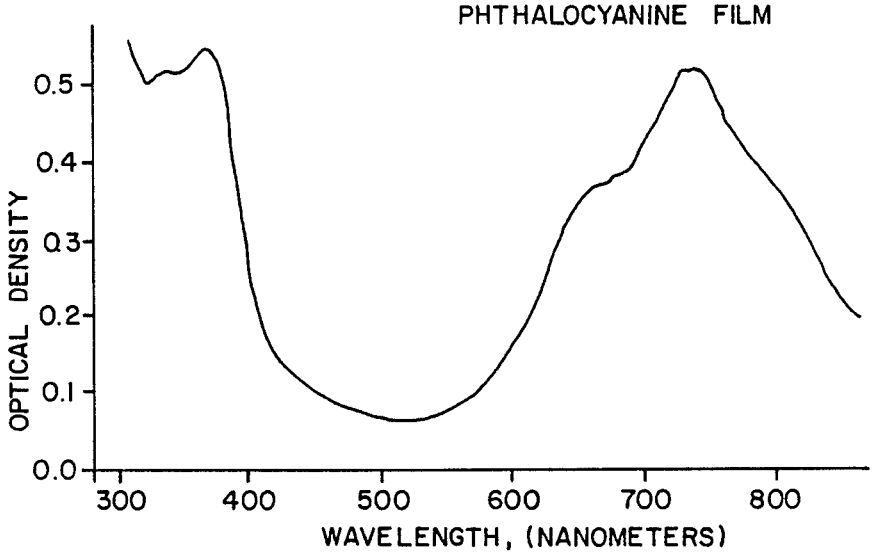
FIG. 5 illustrates the absorption spectrum of evaporated chloroindium phthalocyanine prior to (A), and subsequent to (B) providing an overcoat of the specific arylamine transport layer indicated.
Figure 5B:
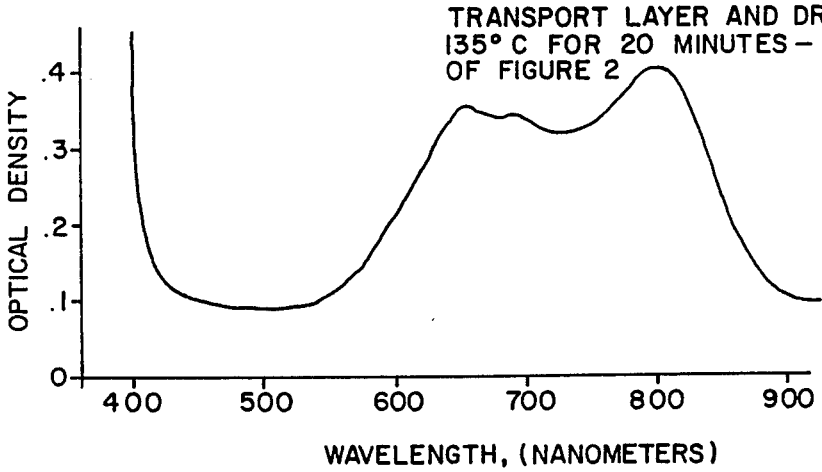

In FIG. 5 there is illustrated the absorption spectrum of the evaporated chloroindinum phthalocyanine photogenerating layer of FIG. 2, prior to (a) and subsequent to (b) overcoating with the amine charge transport layer 19 generated from halogenated solvents, wherein optical density represents the amount of light absorbed as a function of wavelength. Curve 5 (a) indicates that there is a maximum absorption of light occurring at 730 nanometers. Two new absorption bands appear in curve 5 (b), one at 660 nanometers, and one at 800 nanometers indicating photosensitivity for the imaging member of FIG. 2.

The substrate layers may be opaque or substantially transparent, and may comprise any suitable material having the requisite mechanical properties. Thus, the substrate can be comprised of a layer of insulating material such as an inorganic or organic polymeric material, inclusive of Mylar a commercially available polymer; a layer of an organic or inorganic material having a semiconductive surface layer such as indium tin oxide, or aluminum arranged thereon, or a conductive material such as, for example, aluminum, chromium, nickel, brass or the like. The substrate may be flexible or rigid and many have a number of many different configurations, including for example a plate, a cylindrical drum, a scroll, and seamless flexible belt and the like. Preferably, the substrate is in the form of an seamless flexible belt. In some situations, it may be desirable to coat on the back of the substrate, particularly when the substrate is an organic polymeric material, an anti-curl layer, such as for example polycarbonate materials commercially available as Makrolon.

The thickness of the substrate layer depends on many factors, including economical considerations, thus this layer may be of substantial thickness, for example over 100 mils, or of minimum thickness providing there are no adverse effects on the system. In one preferred embodiment, the thickness of this layer ranges from about 3 mils to about 10 mils.

The adhesive layers can be comprised of various suitable materials providing the objectives of the present invention are achieved, including polyesters, polycarbonates, and other similar substances. This layer which is generally applied by known coating techniques is of a thickness of about 0.05 to about 5 microns, or more, and preferably is of a thickness of about 0.05 to 0.1 microns.

The first photogenerating layer functioning as a blue light absorber typically has a thickness of from about 0.05 microns to about 10 microns or more, and is preferably of a thickness of from about 0.05 microns to about 3 microns, however, the thickness of this layer is primarily dependent on the pigment volume loading, which may vary from 5 to 100 volume percent. Generally, it is desirable to provide this layer in a thickness which is sufficient to absorb about 70 percent or more of the incident radiation which is directed upon it in the imagewise or printing exposure step. The maximum thickness of this layer is dependent primarily upon factors such as mechanical considerations, for example whether a flexible photoresponsive device is desired.

Examples of the first photogenerating pigment include those substances which absorb blue light in the wavelength region of from 400 to 600 nanometers, such as known perylenes, thiopyrilliums, chlorodiane blue, and other similar equivalent materials. Also, as first photogenerating substances there can be selected inorganic pigments including trigonal selenium, and selenium alloys ($As_2Se_3$).

A very important layer of the photoresponsive imaging member of the present invention is the chloroindium phthalocyanine photogenerating composition. This material which can be applied by evaporation methods enables an imaging member with a sensitivity higher than some known organic photogenerating pigments, particularly in the infrared region of the spectrum. Accordingly, the imaging members of the present invention as illustrated herein have a sensitivity that is 2.5 times greater than vanadyl phthalocyanine, and more than 3 to 4 times higher than hydroxy squaraine compositions. Specifically, for example the chloroindium phthalocyanine photogenerating composition of the present invention requires an energy of 2.5 ergs per square centimeter, in order to enable one half discharge, that is very little light is required in allowing this device to form images. In contrast, vanadyl phthalocyanine requires about 6 ergs per square centimeter, and hydroxy squaraines require from about 7 to 9 ergs per square centimeter thus substantially more light is required to obtain images. Accordingly, the chloroindium phthalocyanines requiring less light can be desirably used in imaging members incorporated into high speed imaging and duplicating systems, wherein from 60 to 100 copies per minute are possible. Also, this photogenerating pigment comprises substantially 100 percent by weight of the photogenerating layer, accordingly a resinous binder is not needed as is the situation with many prior art imaging members.

Generally, the thickness of the photogenerating layer depends on a number of factors including the thicknesses of the other layers. Accordingly, this layer can range in thickness of from about 0.05 microns to about 10 microns and preferably from about 0.05 microns to about 0.3 microns. The maximum thickness of this layer can, in some instances, be dependent upon factors such as mechanical considerations, for example whether a flexible photoresponsive device is desired.

In several embodiments of the present invention, the chloroindium phthalocyanine composition is subjected to vapor treatment in order to render this pigment photosensitive in the wavelength regions illustrated. Vapor treatment is generally effected by subjecting the chloroindium phthalocyanine to vapors of various solvents including halogenated solvents, such as methylene chloride, dichloroethane, and the like, tetrahydrofuran, and other similar substances. While it is not desired to be limited by theory, it is believed that the vapor treatment enables the chloroindium phthalocyanine photogenerating pigment molecules to orient, similar to single crystals. This treatment is usually necessary with regard to imaging members of the present invention wherein the hole transport layer is situated on the supporting substrate. Accordingly, in this embodiment the photoresponsive imaging member of the present invention is comprised of a supporting substrate, a hole transport layer in contact therewith, a first photogenerating layer, a second photogenerating layer comprised of the chloroindium phthalocyanine compositions of the present invention, and wherein the photogenerating pigment of the second layer has been vapor treated as disclosed herein. In those imaging members of the present invention wherein the hole transport layer is situated as the top layer in contact with the first photogenerating layer or the second photogenerating layer, the chloroindium phthalocyanine composition is apparently rendered photosensitive by the solvent, such as methylene chloride selected for applying the hole transport layer by solution coating.

The charge carrier material selected for the transport layer is comprised of arylamine hole transporting substances, this layer being of various thicknesses, generally however, this layer is of a thickness of from about 5 microns to about 50 microns, and preferably from about 10 microns to about 40 microns. These charge transporting substances are comprised of molecules of the formula:

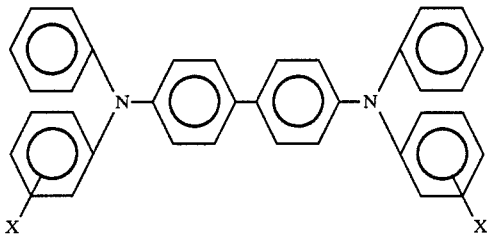

dispersed in a highly insulating and transparent organic resinous binder wherein X is an alkyl group or a halogen, especially those groups selected from the group consisting of (ortho) $CH_3$, (meta) $CH_3$, (para) $CH_3$, (ortho) Cl, (meta) Cl, (para) Cl. The highly insulating resin used has a resistivity of at least $10^{12}$ ohm-cm to prevent undue dark decay, however, it becomes electrically active when it contains from about 10 to 75 weight percent of the substituted N,N,N',N'-tetraphenyl[1,1'-biphenyl)-4-4'-diamines corresponding to the foregoing formula.

Compounds corresponding to the formula illustrated include, for example, N,N'-diphenyl-N,N'-bis(alkylphenyl)-[1,1'-biphenyl]-4,4'-diamine wherein the alkyl is selected from the group consisting of methyl, such as 2-methyl, 3-methyl and 4-methyl, ethyl, propyl, butyl, hexyl and the like. With chloro substitution, the amine is N,N'-diphenyl-N,N'-bis(halo phenyl)-[1,1'-biphenyl]-4,4'-diamine wherein the halo atom is 2-chloro, 3-chloro or 4-chloro.

Examples of the highly insulating transparent resinous inactive binder materials for the transport layer include those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also included within the scope of the present invention are methods of imaging with the photoresponsive devices illustrated herein. These methods of imaging generally involve the formation of an electrostatic latent image on the imaging member, followed by developing the image with a developer composition, subsequently transferring the image to a suitable substrate and permanently affixing the image thereto. In those environments wherein the imaging member is to be used in a printing mode, the imaging method involves the same steps with the exception that the exposure step is accomplished with a laser device, or image bar, rather than a broad spectrum white light source.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

A photoresponsive imaging member was prepared by providing an aluminized Mylar substrate in a thickness of 3 mils, with a DuPont 49000 polyester adhesive layer thereon in a thickness of 0.01 microns, and coating thereover in a vacuum coater the photogenerating pigment chloroindium phthalocyanine with a final thickness of 0.10 microns.

Thereafter, the above photogenerating layer was overcoated with an amine charge transport layer which was prepared as follows:

A transport layer composed of 65 percent by weight Merlon, a polycarbonate resin readily available, was mixed with 35 percent by weight N,N'-diphenyl-N,N'-bis(3-methylphenyl)-1,1'-biphenyl-4,4'-diamine. This solution was mixed to 7 percent by weight in methylene chloride. All of these components were placed in an amber bottle and dissolved. The mixture was coated to provide a layer with a dry thickness of 15 microns on top of the above photogenerating layer, using a multiple clearance film applicator (10 mils wet gap thickness). The resulting member was then dried in a forced air oven at 135° C. for 20 minutes.

The photosensitivity of this member was then determined by electrostatically charging the surface thereof under a corona discharge source until the surface potential, as measured by a capacitively coupled probe attached to an electrometer, attained an initial dark value $V_0$ of −800 volts, the initial surface potential. The front surface of the charged element was then exposed to light from a filtered Xenon lamp, XBO 75 watt source, allowing light in the wavelength range of 400 to 700 nm to reach the members surface. The exposure causing a reduction of the surface potential to half its initial value, E to the one half, was determined, as well as the percent discharge of surface potential due to various exposure energies. The photosensitivity can be considered equivalent to the exposure in ergs/cm$^2$ necessary to discharge the member from the initial surface potential to half that value. The higher the photosensitivity, the smaller the exposure energy required to discharge 50 percent of the surface potential. The photosensitivity results are illustrated in FIG. 4 wherein the percent discharge of surface potential is plotted against various exposure energies. With white light, 400 to 700 nanometers, exposure, the $E_{\frac{1}{2}}$ value, exposure level required to reduce the initial surface potential to ½ its initial value, was found to be 4.3 erg/cm$^2$, and the percent discharge at an exposure level of 10 erg/cm$^2$ was 75, reference FIG. 4(*a*).

EXAMPLE II

The photosensitivity of the imaging member as prepared in Example I was then evaluated with infrared light of a wavelength of 830 nanometers generated from a Xenon lamp. The photosensitivity results are shown in FIG. 4(*b*) wherein the $E_{\frac{1}{2}}$ value was determined to be 2.5 erg/cm$^2$, and the percent discharge at an exposure level of 10 erg/cm$^2$ was 82.

EXAMPLE III

The photosensitivity of the chloroindium phthalocyanine in the white light region, 400 to 700 nanometers, was improved by incorporating into the imaging member a second photogenerating layer. This was accomplished by repeating the procedure of Example I with the exception that an adhesive layer is not needed, and wherein there was applied on the aluminized Mylar in a thickness of 0.10 microns, as a first photogenerating layer, N,N'-dimethylperylene-3,4,9,10-tetracarboxyl diimide, followed by the deposition in a thickness of 0.10 microns, of the chloroindium phthalocyanine. Under white light exposure, the $E_{\frac{1}{2}}$ value was found to be 3.5 erg/cm$^2$ and the percent discharge at an exposure of 10 erg/cm$^2$ was 85. Both the $E_{\frac{1}{2}}$ and percent discharge values are substantially better, indicating higher photosensitivity, than those of the imaging member of Example I.

EXAMPLE IV

There was also prepared an imaging member by repeating the procedure of Example I, with the exception that the amine transport layer was first applied to the substrate followed by a top coating of the chloroindium photogenerating pigment. More specifically, a 15 micron amine charge transport layer of Example I was coated onto an aluminized Mylar substrate 3 mils in thickness. The transport layer was then dried at 135° C. for 20 minutes, and chloroindium phthalocyanine (Cl In Pc), 0.1 microns in thickness, was deposited on top of the transport layer in a vacuum coater. Thereafter the resulting photosensitive member was exposed to methylene chloride vapor for about 10 minutes to affect a structure change in the chloroindium phthalocyanine. The photosensitive member was then dried again at 135° C. for 20 minutes. The photosensitivity of this member was determined by positively charging the surface thereof to an initial dark value of +400 volts. Under white light exposure, the $E_{\frac{1}{2}}$ value was found to be 1.7 erg/cm$^2$, and the percent discharge at an exposure level of 10 erg/cm$^2$ was 70. Under 830 nanometers light, the $E_{\frac{1}{2}}$ and percent discharge were found to be 1.6 erg/cm$^2$ and 78 respectively.

The discharge curves of FIG. 4 for the members of Examples I, II and III indicate that images of high quality and satisfactory resolution can be generated in xerographic imaging and printing systems.

Other modifications of the present invention may occur to those skilled in the art based upon a reading of the present disclosure, and these modifications are intended to be included within the scope of the present invention.

We claim:

1. An improved photoresponsive imaging member consisting essentially of (1) a supporting substrate, (2) an adhesive layer, (3) a photogenerating layer in contact therewith comprised of chloroindium phthalocyanine, and (4) a hole transport layer comprised of an arylamine of the following formula dispersed in an inactive resinous binder composition:

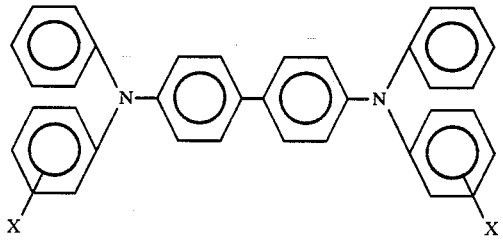

wherein X is an alkyl group, or a halogen.

2. An improved photoresponsive imaging member in accordance with claim 1 wherein X is selected form the group consisting of ortho ($CH_3$), meta ($CH_3$), para ($CH_3$), ortho (Cl), meta (Cl), and para (Cl).

3. An improved photoresponsive imaging member in accordance with claim 1 wherein the diamine is N,N'-diphenyl-N,N'-bis(3-methylphenyl)-[1,1'-biphenyl]-4,4'-diamine.

4. An imaging member in accordance with claim 1, wherein the substrate is selected from the group consisting of polymeric compositions and conductive materials.

5. An imaging member in accordance with claim 1, wherein the adhesive layer is a polyester.

6. An imaging member in accordance with claim 1, wherein the chloroindium phthalocyanine layer is vapor treated.

7. An imaging member in accordance with claim 1, wherein the vapor treatment is effected with a halogenated organic solvent.

8. An improved imaging member in accordance with claim 1, wherein the photogenerating layer is of a thickness of from about 0.05 microns to about 10 microns.

9. An imaging member in accordance with claim 1, wherein the thickness of the hole transport layer is from about 5 microns to about 50 microns.

10. A method of imaging which comprises generating an electrostatic latent image on the imaging member of claim 1, thereafter developing this image and subsequently transferring the image to a suitable substrate.

11. A method of imaging in accordance with claim 10, wherein the chloroindium phthalocyanine is vapor treated.

12. A method of imaging in accordance with claim 10, wherein the amine hole transport molecule is N,N'-diphenyl-N,N'-bis(3-methylphenyl)-[1,1'-biphenyl]-4,4'-diamine.

13. An improved layered photoresponsive imaging member consisting essentially of a supporting substrate, an adhesive layer, a first photogenerating layer, a second photogenerating layer consisting essentially of chloroindium phthalocyanine, and as a top layer in contact with the second photogenerating layer, a hole transport layer comprised of an aryl amine dispersed in an inactive resinous binder.

14. An improved imaging member in accordance with claim 13 wherein the first photogenerating layer consists of substances which absorb blue light in the region of from 400 to 600 nanometers.

15. An improved imaging member in accordance with claim 13 wherein the first photogenerating layer is of N,N'-dimethyl perylene-3,4,9,10-tetracarboxyl diimide.

16. An improved imaging member in accordance with claim 13 wherein the hole transporting substance is N,N'-diphenyl-N,N'-bis(3-methylphenyl)-[1,1'-biphenyl]-4,4'-diamine.

17. An improved imaging member in accordance with claim 13 wherein the second photogenerating chloroindium phthalocyanine layer is vapor treated.

18. An improved imaging member in accordance with claim 17 wherein the vapor treatment is affected with a halogenated organic solvent.

19. An improved imaging member in accordance with claim 13 wherein the first photogenerating pigment and second photogenerating pigment are dispersed in a resionous binder.

20. An improved imaging member in accordance with claim 19 wherein the resinous binder is a polycarbonate.

21. A method of imaging which consists essentially of generating an electrostatic latent image on the imaging member of claim 14, developing this image, and subsequently transferring the image to a suitable substrate and optionally, permanently affixing the image thereto.

22. A method of imaging in accordance with claim 21 wherein the amine hole transport molecule is N,N'-diphenyl-N,N'-bis(3-methylphenyl)-[1,1'-biphenyl]-4,4'-diamine.

23. A method of imaging in accordance with claim 21 which consisting essentially of generating an electrostatic image on the photoresponsive imaging member of claim 13, developing this image, transferring the image to a suitable substrate, and optionally, permanently affixing the image thereto.

24. The method of imaging in accordance with claim 23 wherein the amine hole transport molecule is N,N'-diphenyl-N,N'-bis(3-methylphenyl)-[1,1'-biphenyl]-4,4'-diamine.

25. A method of printing which consisting essentially of generating the characters to be printed on the photoresponsive imaging member of claim 13 developing this image, transferring the image to a suitable substrate, and optionally, permanently affixing the image thereto.

26. A method of imaging in accordance with claim 25 wherein the hole transport molecule is N,N'-diphenyl-N,N'-bis(3-methylphenyl)-[1,1'-biphenyl]-4,4'-diamine.

27. A method of imaging in accordance with claim 25 wherein the first photogenerating pigment is N,N'-dimethyl perylene-3,4,9,10-tetracarboxyl diimide.

* * * * *